US009261850B2

(12) United States Patent
Koseki

(10) Patent No.: US 9,261,850 B2
(45) Date of Patent: Feb. 16, 2016

(54) IMAGE FORMING APPARATUS AND COLLECTING CONTAINER

(71) Applicant: CANON KABUSHIKI KAISHA, Tokyo (JP)

(72) Inventor: Hiromichi Koseki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/491,132

(22) Filed: Sep. 19, 2014

(65) Prior Publication Data

US 2015/0086256 A1 Mar. 26, 2015

(30) Foreign Application Priority Data

Sep. 20, 2013 (JP) ..... 2013-195150

(51) Int. Cl.
*G03G 15/00* (2006.01)
*G03G 21/12* (2006.01)
*G03G 21/16* (2006.01)

(52) U.S. Cl.
CPC ..... *G03G 21/12* (2013.01); *G03G 21/1647* (2013.01)

(58) Field of Classification Search
CPC .... G03G 21/10; G03G 21/1647; G03G 21/12
USPC ..... 399/360
See application file for complete search history.

(56) References Cited

U.S. PATENT DOCUMENTS 7,606,523 B2 10/2009 Kubo

FOREIGN PATENT DOCUMENTS

| | | | |
|---|---|---|---|
| JP | 2008-107436 | A | 5/2008 |
| JP | 2010-038993 | A | 2/2010 |
| JP | 2010-160512 | A | 7/2010 |
| JP | 2012-203383 | A | 10/2012 |

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

An image forming apparatus includes a collecting container; connecting portions; shutters; first urging members for urging the shutters; a movable member which is accommodated toward the collecting container by contact with the main assembly when the collecting container is mounted in a mounting portion and which is projected outwardly from a side portion of the collecting container when the collecting container is dismounted from the mounting position; and a second urging member for urging the movable member. When the collecting container is mounted in the main assembly, the first urging members and the second urging member are provided so that a sum of rotation moment acting on the collecting container by the first urging members and rotation moment acting on the collecting container by the second urging member are directed opposite to each other.

6 Claims, 10 Drawing Sheets

(a)

(b)

(c)

(a) COMP. EX (b) EMB. 1

(a)

(b)

(a)

(b)

IMAGE FORMING APPARATUS AND COLLECTING CONTAINER

FIELD OF THE INVENTION AND RELATED ART

The present invention relates to an image forming apparatus for collecting a toner fed from a main assembly into a collecting container detachably mountable to the main assembly of the image forming apparatus, and specifically relates to the collecting container connected to the main assembly at connecting portions provided with shutters.

In the image forming apparatus in which a toner image is formed using the toner and then is transferred onto a sheet, a transfer residual toner is generated with the transfer of the toner image, and therefore a cleaning device is provided to collect the transfer residual toner. There is also the case where a developer which becomes old is collected from a developing device with an operation of the developing device. The toner collected by the cleaning device or the developing device is accumulated in the collecting container provided detachably mountable to the main assembly, and when the collecting container becomes full, there is the case where the collecting container in its entirety is dismounted from the main assembly and then is replaced with a blank collecting container (Japanese Laid-Open Patent Application (JP-A) 2008-107436, JP-A 2010-38993 and JP-A 2010-160512).

In the image forming apparatus to which the collecting container is detachably mountable, when the collecting container is separated from the main assembly and then is overturned, there is a possibility that a collected toner is scattered to a periphery. In order to prevent the overturning of the collecting container, in JP-A 2008-107436 and JP-A 2010-38993, the collecting container is provided with an overturning-preventing member, stored in an accommodating portion provided on a container portion for accumulating the toner, for supporting the container portion in a state in which the overturning-preventing member is rotated and developed toward an outside.

On the other hand, at the connecting portion for connecting the main assembly of the image forming apparatus and the collecting container, the shutter for preventing leakage-out of the toner is provided. In JP-A 2010-160512, both the main assembly and the collecting container are provided with the shutter. The shutter is urged in a closing direction by an urging member, and automatically seals openings, provided in the main assembly side and the collecting container side, with an operation for separating the collecting container from the main assembly.

The shutter provided at the connecting portion between the main assembly of the image forming apparatus and the collecting container urges the collecting container in a direction of separating the collecting container from the main assembly. For that reason, in the case where the collecting container is connected to the image forming apparatus at a plurality of connecting portions, a sum of rotation moment with which a plurality of shutters act on the collecting container is not canceled at both ends with respect to a horizontal direction and thus unnecessary rotation moment acts on the collecting container in some instances.

SUMMARY OF THE INVENTION

A principal object of the present invention is to provide an image forming apparatus and a collecting container which are capable of alleviating unnecessary rotation moment acting on the collecting container.

According to an aspect of the present invention, there is provided an image forming apparatus comprising: a collecting container, provided detachably mountable to a main assembly, for collecting a toner fed from the main assembly; a plurality of connecting portions, provided at one side surface of the collecting container, for connecting the main assembly and the collecting container; a plurality of shutters for opening and closing the plurality of connecting portions, respectively; a plurality of first urging members for urging the plurality of shutters, respectively, in a closing direction; a movable member provided movably at a bottom of the collecting container, wherein the movable member is accommodated toward the collecting container by contact with the main assembly when the collecting container is mounted in a mounting portion, and is projected outwardly than a side portion of the collecting container when the collecting container is dismounted from the mounting position; and a second urging member for urging the movable member in a direction of projecting the movable member from the collecting container, wherein when the collecting container is mounted in the main assembly, the plurality of first urging members and the second urging member are provided so that a sum of rotation moment acting on the collecting container by the plurality of first urging members, and rotation moment acting on the collecting container by the second urging member are directed opposite to each other.

According to another aspect of the present invention, there is provided a collecting container provided detachably mountable to a main assembly of an image forming apparatus, comprising: an accommodating portion for accommodating a toner; a plurality of inflowing portions, provided at one side surface of the collecting container, for permitting inflow of the toner; a plurality of shutters for opening and closing the plurality of inflowing portions, respectively; a plurality of first urging members for urging the plurality of shutters, respectively, in a closing direction; a movable member provided movably at a bottom of the accommodating portion, wherein the movable member is accommodated toward the collecting container by contact with the main assembly when the collecting container is mounted in the main assembly, and is projected outwardly than a side portion of the collecting container when the collecting container is dismounted from the mounting position; and a second urging member for urging the movable member in a direction of projecting the movable member from the collecting container, wherein when the collecting container is mounted in the main assembly, the plurality of first urging members and the second urging member are provided so that a sum of rotation moment acting on the collecting container by the plurality of first urging members, and rotation moment acting on the collecting container by the second urging member are directed opposite to each other.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described specifically with reference to the drawings.

(Image forming apparatus)

Figure 1:
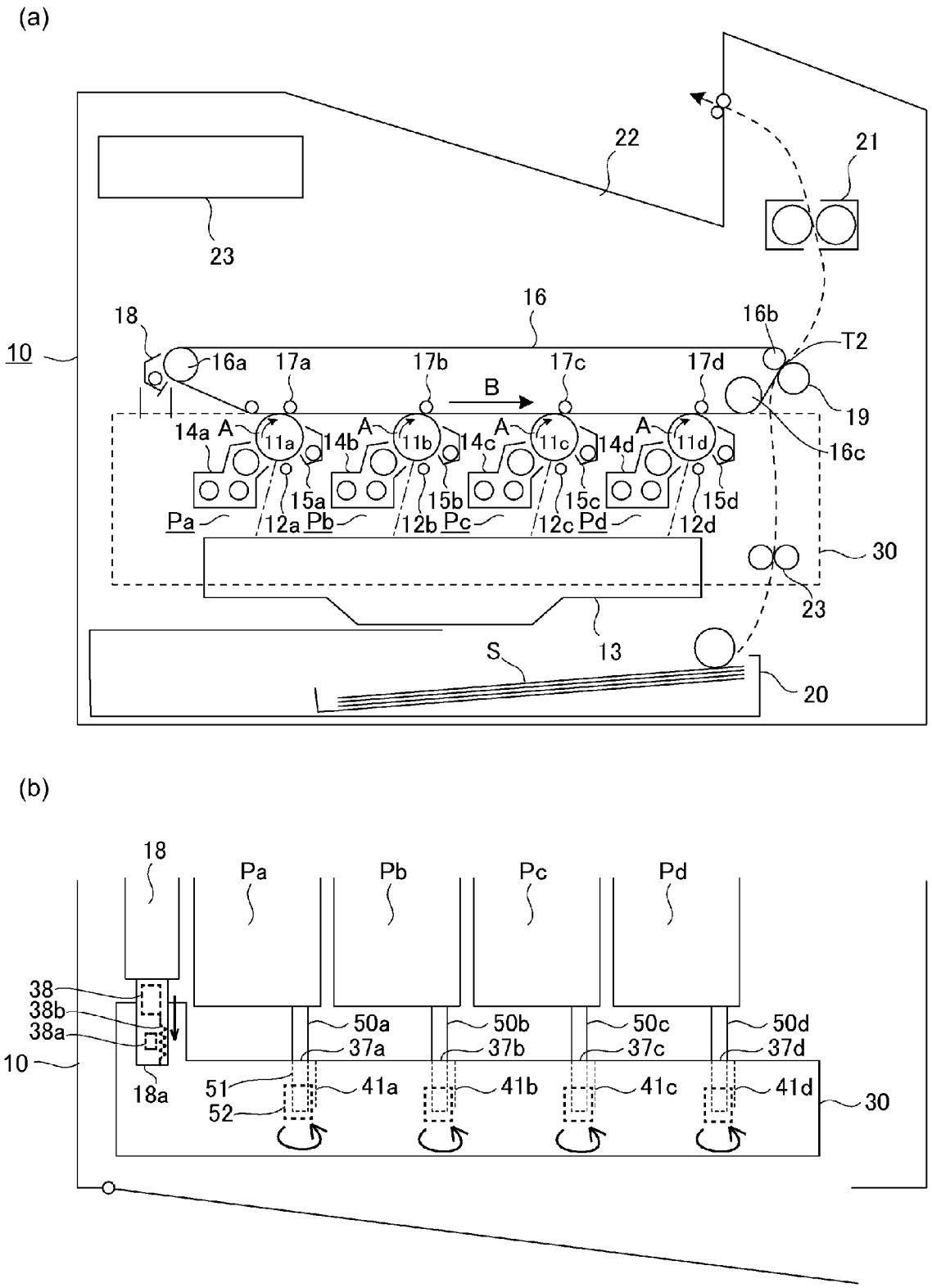
In FIG. 1, (a) and (b) are illustrations of a structure of an image forming apparatus.

In FIG. 1, (a) and (b) are illustrations of a structure of an image forming apparatus. In FIG. 1, (a) shows a longitudinal section of the image forming apparatus, and (b) shows a connected state of a collected toner box.

As shown in (a) of FIG. 1, an image forming apparatus 10 is an intermediary transfer type full-color printer of a tandem type in which image forming portions Pa, Pb, Pc and Pd for yellow, magenta, cyan and black, respectively, are arranged along a downward surface of an intermediary transfer belt 16. An operation of the image forming apparatus 10 is controlled by a controller 23.

At the image forming portion Pa, a yellow toner image is formed on a photosensitive drum 11*a* and then is transferred onto the intermediary transfer belt 16. At the image forming portion Pb, a magenta toner image is formed on a photosensitive drum 11*b* and then is transferred onto the intermediary transfer belt 16. At the image forming portions c and d, cyan and black toner images are formed on photosensitive drums 11*c* and 11*d*, respectively, and then are transferred onto the intermediary transfer belt 16.

A sheet (recording material) S is taken out from a cassette 20 one by one, and then is on stand-by at a registration roller pair 23. The registration roller pair 23 feeds the sheet S to a secondary transfer portion T2 while being timed to the toner images on the intermediary transfer belt 16. The sheet S on which the four color toner images are secondary transferred at the secondary transfer portion T2 is fed to a fixing device 21 and an image thereon is fixed under application of heat and pressure, and thereafter the sheet S is discharged onto a discharge tray 22.

(Image forming portion)

As shown in (a) of FIG. 1, the image forming portions Pa, Pa, Pc and Pd have the substantially same constitution except that colors of toners used in developing devices 14*a*, 14*b*, 14*c* and 14*d*, respectively, are yellow, magenta, cyan and black, respectively, which are different from each other. In the following, the yellow image forming portion Pa is described, and redundant explanation about other image forming portions Pb, Pc and Pd will be omitted.

The image forming portion Pa includes, at a periphery of the photosensitive drum 11*a*, a charging roller 12*a*, an exposure device 13, the developing device 14*a*, a transfer roller 17*a* and a drum cleaning device 15*a*. The photosensitive drum 11*a* is prepared by forming a photosensitive layer at an outer peripheral surface thereof, and is rotated in an arrow A direction. The charging roller 12*a* electrically charges a surface of the photosensitive drum 11*a* to a negative dark portion potential VD uniformly. The exposure device 13 scans the surface of the photosensitive drum 11*a* with a laser beam, so that an electrostatic image for an image is formed on the photosensitive drum 11*a*. The developing device 14*a* develops the electrostatic image on the photosensitive drum 11*a* into a toner image by carrying, on a developing sleeve, a developer containing a toner and a carrier.

The transfer roller 17*a* forms a transfer portion for the toner image between the photosensitive drum 11*a* and the intermediary transfer belt 16. By applying a DC voltage to the transfer roller 17*a*, the toner image carried on the photosensitive drum 11*a* is transferred onto the intermediary transfer belt 16.

The intermediary transfer belt 16 is extended around and supported by a tension roller 16*a*, a driving roller 16*c* and an inner secondary transfer roller 16*b*, and is driven by the driving roller 8*b* to be rotated in an arrow B direction. A secondary transfer roller 19 contacts the intermediary transfer belt 16 supported by the inner secondary transfer roller 16*b* to form the secondary transfer portion T2 for the toner image.

(Collected Toner)

As shown in (a) of FIG. 1, with the image formation, the transfer residual toner is deposited on the photosensitive drum 11*a*. The transfer residual toner is scraped off by a cleaning blade of the drum cleaning device 15*a*, and then is fed toward the front side of the image forming apparatus 10 by a feeding screw to be accumulated in a collecting container 30. The transfer residual toner deposited on the intermediary transfer belt 16 is scraped off by a cleaning blade of a belt cleaning device 18, and then is fed toward the front surface side of the image forming apparatus 10 by the feeding screw to be accumulated in the collecting container 30.

When a two-component developer is continuously stirred over a long time, a charging performance is gradually lowered, and therefore the two-component developer in a certain proportion is steadily taken out from the developing device 14*a* and is collected in the collecting container 30. Into the developing device 14*a*, in order to replenish the toner consumed with the image formation, a supply developer containing the carrier in an amount of about 10% is supplied. The developer circulating in the developing device 14*a* overflows the developing device 14*a* little by little in a proportion depending on a toner consumption amount with the image formation, and then is accumulated as a deteriorated developer in the collecting container 30.

As shown in (b) of FIG. 1, a connecting portion of the belt cleaning device 18 and delivery portions 50*a*, 50*b*, 50*c* and 50*d* of the drum cleaning devices 15*a*, 15*b*, 15*c* and 15*d* are individually provided with shutters, and are connected to the collected toner box 30.

(Collected Toner Box)

Figure 2:
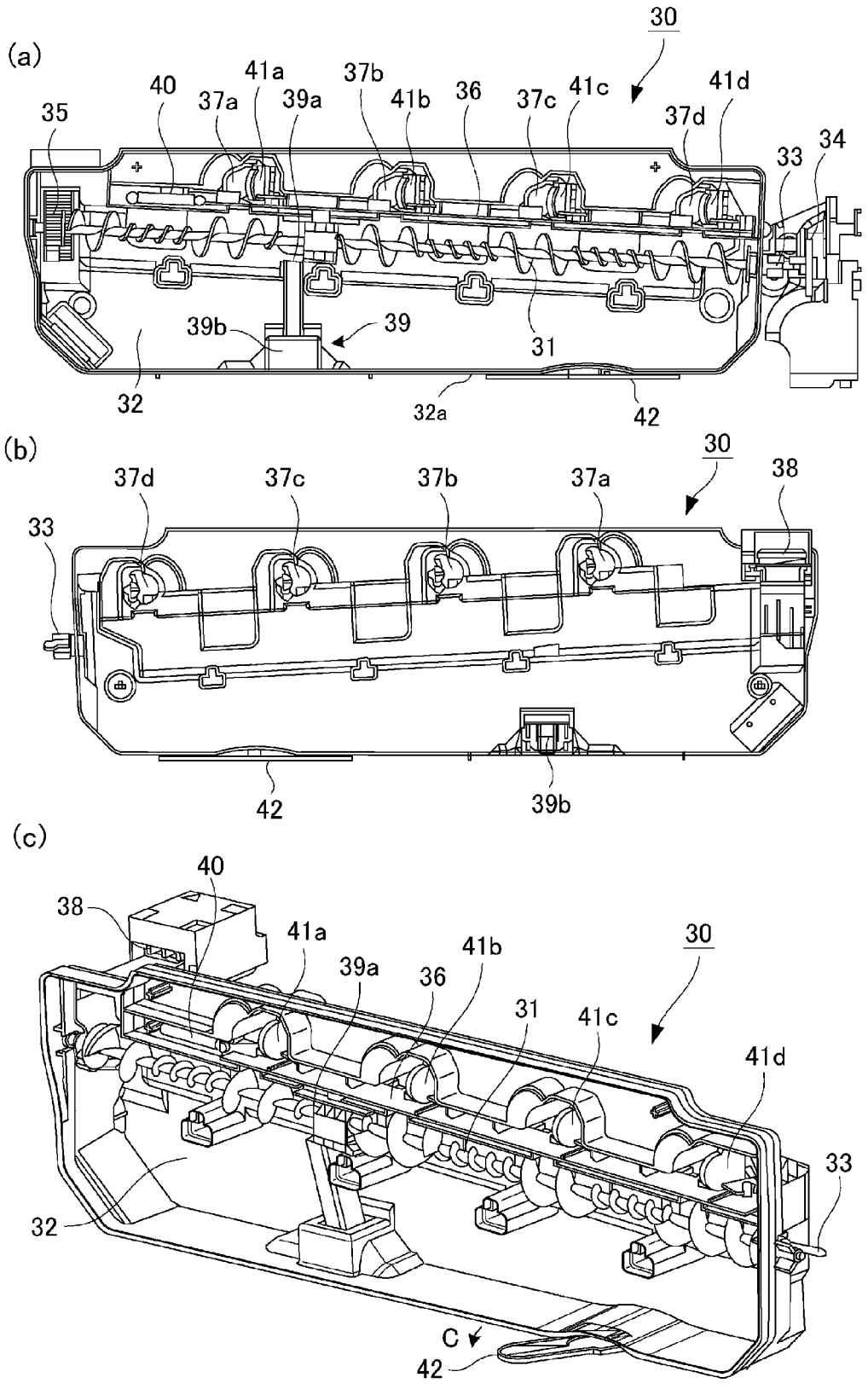
In FIG. 2, (a), (b) and (c) are illustrations of a structure of a collected toner box.
Figure 3:
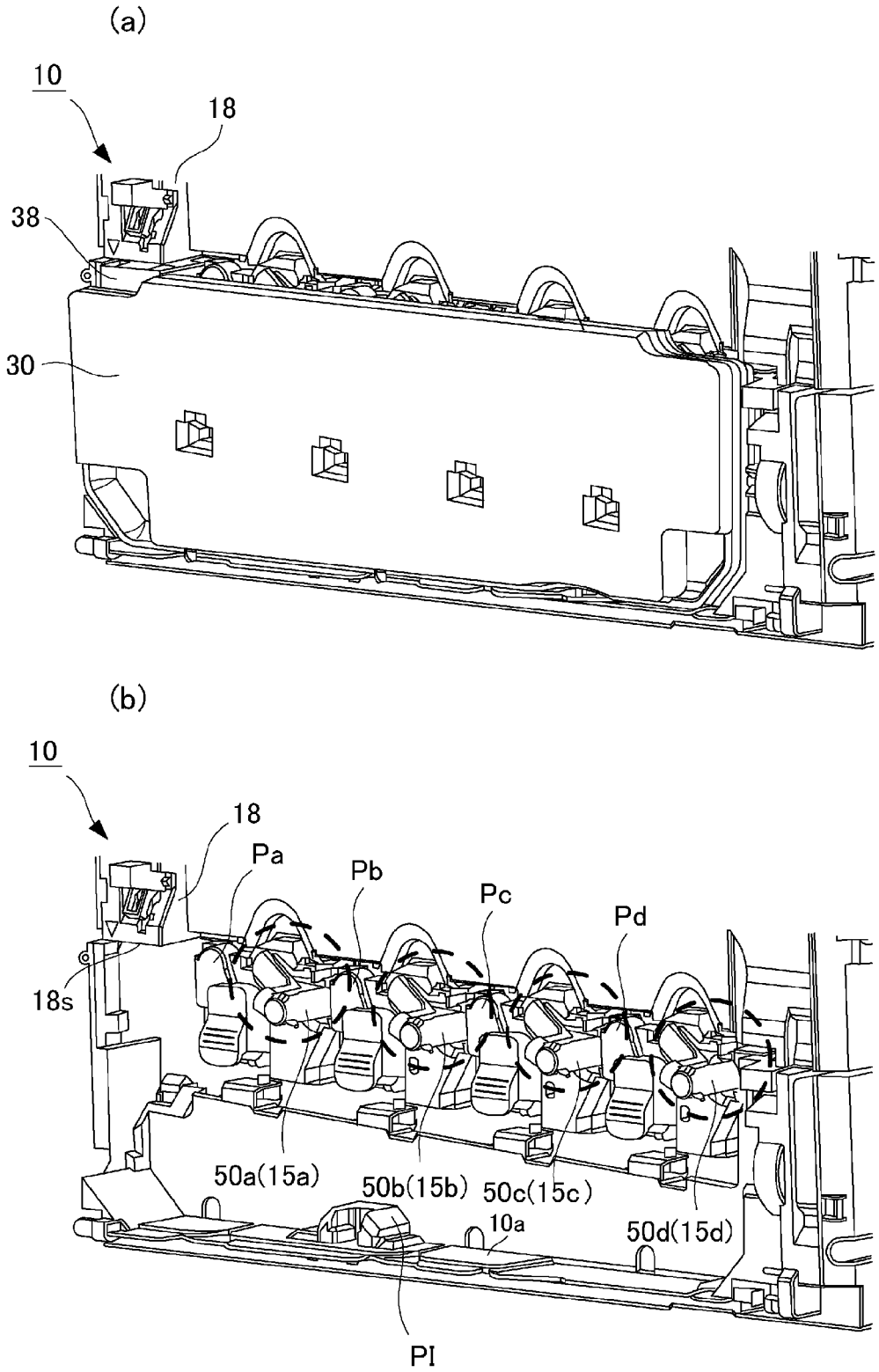
In FIG. 3, (a) and (b) are illustrations of a mounted state and a dismounted state, respectively, of the collected toner box.

In FIG. 2, (a), (b) and (c) are illustrations of a structure of the collected toner box. In FIG. 3, (a) and (b) are illustrations of a mounted state and a dismounted state, respectively, of the collected toner box. In FIG. 2, (a) is a sectional front view of the collected toner box, (b) is a rear view of the collected toner box, and (c) is perspective view of the collected toner box. In FIG. 3, (a) shows the mounted state in which the collected toner box is mounted in the image forming apparatus, and (b) shows the dismounted state in which the collected toner box is dismounted from the image forming apparatus.

As shown in (a) of FIG. 2, a stirring screw 31 stirs the toner accumulated at an accommodating portion 32 of the collected toner box 30. A screw flag 33 is constrained by an interval of bosses formed on a coupling 34, so that a driving force from a motor in the image forming apparatus side is transmitted to the stirring screw 31. The collected toner discharged into the collected toner box 30 is flattened in the accommodating portion 32 by the stirring screw 31 when the collected toner is accumulated to a height of the stirring screw 31.

A stirring paddle 35 is driven by an unshown crank shaft interrelated with the stirring screw 31, and is reciprocated in a direction perpendicular to the surface of the drawing sheet. The stirring paddle 35 scrapes off the toner, into the accommodating portion 32, discharged from the intermediary transfer belt cleaning device 18 shown in (a) of FIG. 1 into the collected toner box 30 and then deposited in a space inside a shutter 38 shown in (b) of FIG. 2.

(Full-State Detection)

As shown in (a) of FIG. 2, in the accommodating portion 32, when the collected toner flattened by the stirring screw 31 reaches an entrance 39*a* to a toner amount detecting portion 39*b*, the collected toner enters the inside of the toner amount detecting portion 39. The toner amount detecting portion 39*b* causes a photo-interruptor PI, provided in the image forming apparatus 10 side as shown in (b) of FIG. 3, to continuously monitor presence or absence of the toner. When the collected toner is accumulated at the collected toner detecting portion 39*b* and a detection optical path of the photo-interruptor PI is blocked, the controller 23 (FIG. 1) discriminates that the collected toner box is full, and displays a message of "Exchange requirement of collected toner box 30" on an operating panel.

(Mounting and Dismounting of Collected Toner Box)

As shown in (b) of FIG. 3, when the collected toner box 30 (FIG. 2) is dismounted from a predetermined position at a lower position of the image forming apparatus, the belt cleaning device 18 and the image forming portions Pa, Pb, Pc and Pd are exposed. From the image forming portions Pa, Pb, Pc and Pd, the delivery portions 50*a*, 50*b*, 50*c* and 50*d* project. Each of the belt cleaning device connecting portion 18*s* and the delivery portions 50*a*, 50*b*, 50*c* and 50*d* of the drum cleaning devices 15*a*, 15*b*, 15*c* and 15*d* is sealed with a shutter.

As shown in (a) of FIG. 2, between an upper space connected to the delivery portions 50*a*, 50*b*, 50*c* and 50*d* and the accommodating portion 32 disposed at the lower portion where the toner is to be accumulated, a sealing member 36 is urged in an urging direction by a tension spring 40. Receiving ports 37*a*, 37*b*, 37*c* and 37*d* are provided with receiving port shutters 41*a*, 41*b*, 41*c* and 41*d*, respectively, each opening and closing in interrelation with the sealing member 36.

The collected toner box 30 taken out from the image forming apparatus 10 is in a second state (self-supporting state). In the second state, the sealing member 36 and the receiving port shutters 41*a*, 41*b*, 41*c* and 41*d* maintain a sealing state, and even when the collected toner box overturns, do not spill the toner toward the outside. In the second state, the sealing member 36 sealing between a receiving port 37 and the accommodating portion 32 seals between an entrance 39*a* of a toner detecting portion and the accommodating portion 32, and therefore even when the collected toner box 30 overturns, the toner does not enter the entrance 39*a*.

As shown in (a) of FIG. 3, the collected toner box 30 is mounted to a predetermined lower position of the image forming apparatus 10 by inserting the delivery portions 50*a*, 50*b*, 50*c* and 50*d* into the receiving ports 37*a*, 37*b*, 37*c* and 37*d*. When the collected toner box 30 is mounted in the image forming apparatus 10, to a side surface portion of the collected toner box 30 with respect to a longitudinal direction, a belt cleaning device connecting portion 18*s* and the delivery portions 50*a*, 50*b*, 50*c* and 50*d* are connected. As a result, the collected toner box 30 is in a first state (mounted state) in which the collected toner box 30 is capable of receiving the collected toner. The transfer residual toner collected by the drum cleaning devices 15*a*, 15*b*, 15*c* and 15*d* is discharged into the collected toner box 30 through a delivery port 51*a* (FIG. 4) provided in a lower side of the delivery portions 50*a*, 50*b*, 50*c* and 50*d*.

As shown in (a) of FIG. 2, in the first state, the receiving port shutters 41*a*, 41*b*, 41*c* and 41*d* are urged by the delivery portions 50*a*, 50*b*, 50*c* and 50*d* to be opened toward an inside. In interrelation with the receiving port shutter 41, the sealing member 36 slides against the tension spring 40 to cause the receiving ports 37*a*, 37*b*, 37*c* and 37*d* to communicate with the accommodating portion 32.

(Connection of Intermediary Transfer Belt Cleaning Device)

As shown in (b) of FIG. 1, a collected toner discharging portion 18*a* of the intermediary transfer belt cleaning device 18 is provided with a shutter 38 which opens and closes by sliding in an insertion and extraction direction of the collected toner box 30. The shutter 38 is urged in a sealing direction by a shutter spring 38*b*, and in the second state in which the shutter 38 is dismounted from the image forming apparatus 10, the shutter 38 always maintains a sealed state of the opening 38*a*, and even when the collected toner box 30 overturns, the shutter 38 does not spill the toner to the outside. The shutter 38 slides in an open direction with the connection of the collected toner box 30 to cause the belt cleaning device 18 and the inner space of the collected toner box 30 to communicate with each other.

In the case of the shutter 38 sliding in the insertion and extraction direction of the collected toner box 30, it is possible to ensure a space, for retracting the shutter in an open state, in a rear side where the collected toner box 30 to be inserted. However, in the rear side of the delivery portions 50*a*, 50*b*, 50*c* and 50*d* where the collected toner box 30 is to be inserted, there is no space for retracting the shutter sliding in the insertion and retraction direction of the collected toner box 30.

Therefore, the delivery portions 50*a*, 50*b*, 50*c* and 50*d* are provided with shutters 52 for sealing openings of the delivery portions 50*a*, 50*b*, 50*c* and 50*d* by rotation of the shutters 52 coaxially with the delivery portions 50*a*, 50*b*, 50*c* and 50*d*.

(Structure of Delivery Portion)

Figure 4:
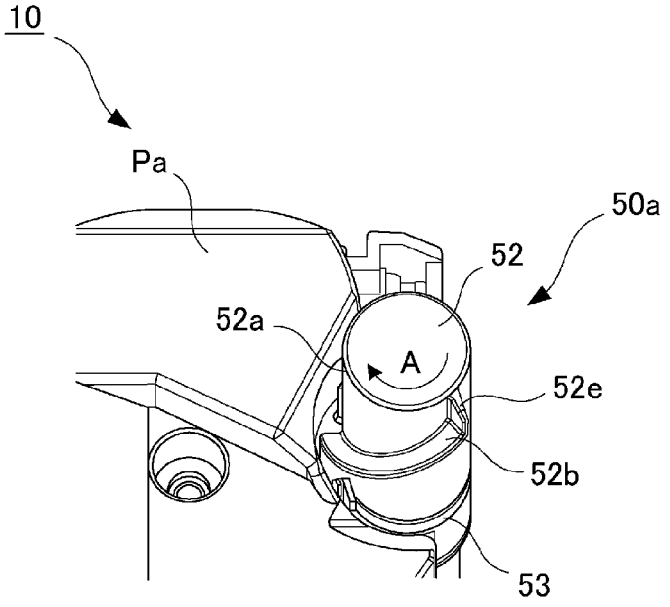
In FIG. 4, (a), (b) and (c) are illustrations of a shutter mechanism.
Figure 4:
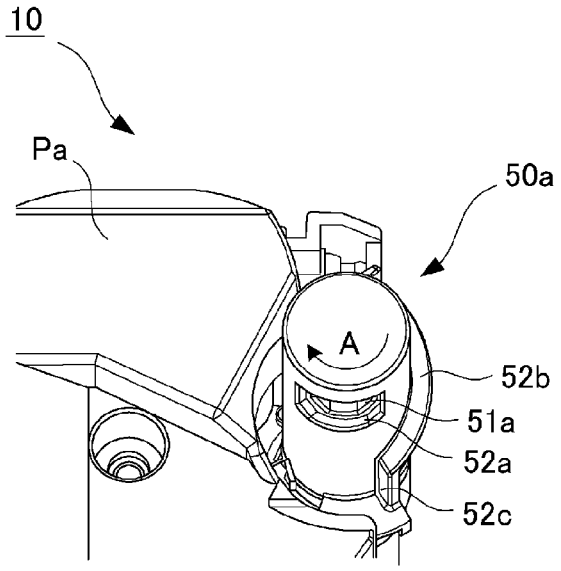
Figure 4:
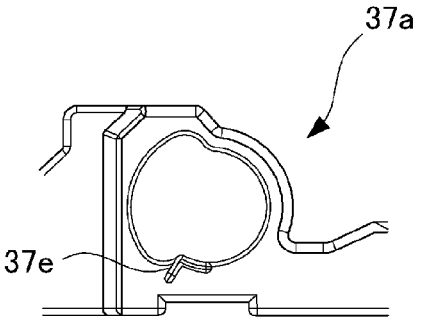
Figure 5:
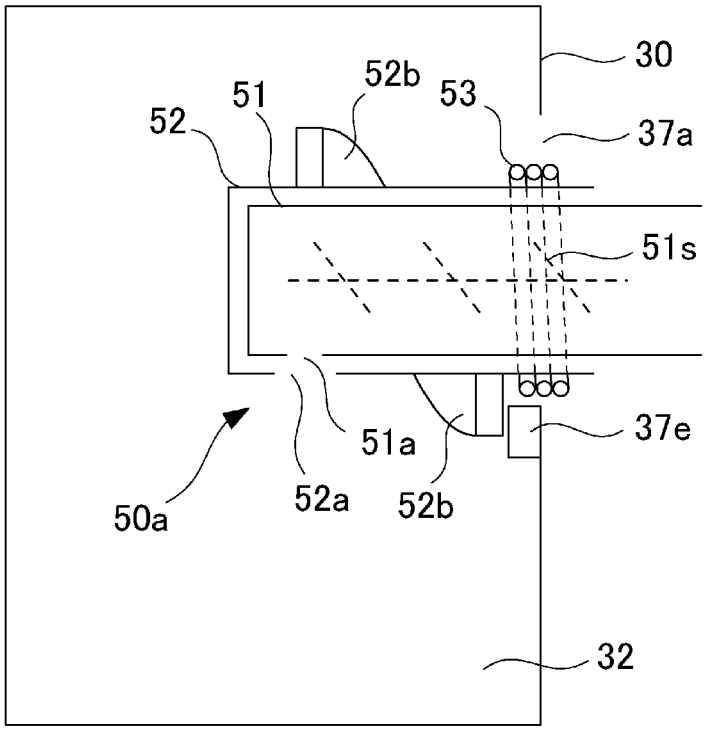
FIG. 5 is a schematic view of an operation of the shutter mechanism.
Figure 6:
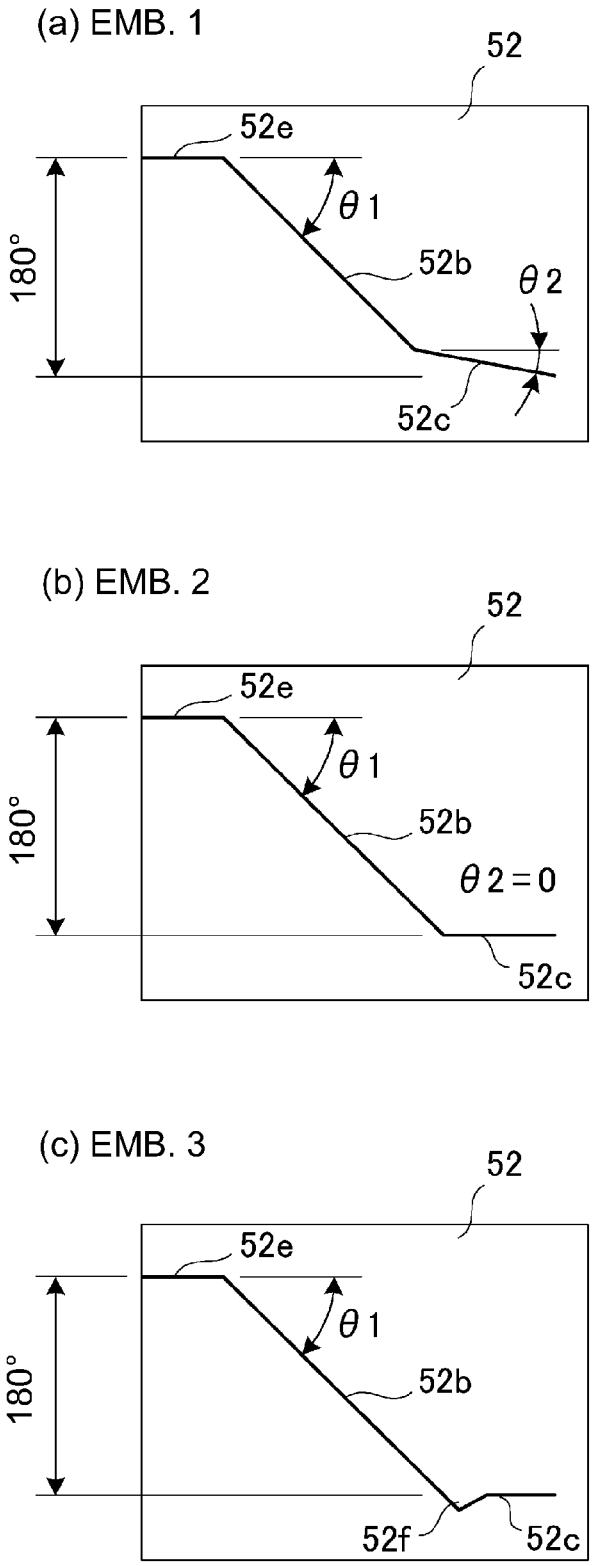
In FIG. 6, (a), (b) and (c) each shows an operation of a blind shutter.

In FIG. 4, (a) to (c) are illustrations of a shutter mechanism. FIG. 5 is a schematic view of an operation of the shutter mechanism. In FIG. 6, (a) to (c) are illustrations of an operation of a blind shutter. In FIG. 4, (a) shows a sealed state, (b) shows an open state, and (c) shows a shutter driving portion disposed in the collected toner box side.

As shown in (b) of FIG. 3, the delivery portion 50*a* projecting from the image forming portion Pa is inserted into the collected toner box 30 to discharge the collected toner.

As shown in (a) of FIG. 4, the sealing shutter 52 is formed in a closed-end cylindrical shape, and is 180°-rotatable coaxially with a feeding pipe 51 along an outer peripheral surface of a free end portion of the feeding pipe 51. The sealing shutter 52 rotates along the peripheral surface of the feeding pipe 51, and therefore the retraction space is limited to a rotation region of the sealing shutter 52 even in the sealing state, the open state and an operation process. Accordingly, compared with a shutter 38 (FIG. 2) sliding in the insertion direction, it is possible to seal the delivery portion 51*a* in a small space.

As shown in (a) of FIG. 4, in an initial stage in which the collected toner box 30 is pushed in and mounted in the image forming apparatus 10, the sealing shutter 52 of the delivery portion 50*a* is in the sealing state and prevents drop of the toner from the delivery portion 50*a*.

As shown in (b) of FIG. 4, in the first state in which the collected toner box 30 is mounted in the image forming apparatus 10, the sealing shutter 52 of the delivery portion 50*a* is held in the open state, so that the toner can drop from the delivery portion 50*a* into the collected toner box 30.

As shown in (c) of FIG. 4, the receiving port 37*a* of the collected toner box 30 is provided with a contact rib 37*e* for rotating the sealing shutter 52 in contact with a helical rib 52*b* of the sealing shutter 52.

As shown in FIG. 5, the delivery portion 50*a* is connected to the receiving port 37*a* of the collected toner box 30. The collected toner is fed by the feeding screw 51*s* toward the delivery port 51*a* in the feeding pipe 51. The sealing shutter 52 is urged by a helical torsion coil spring 53, and therefore in a state in which the collected toner box 30 is not connected, the sealing shutter 52 always keeps the delivery port 51*a* in a sealed state. In a process in which the delivery portion 50*a* is inserted into the collected toner box 30, the contact rib 37*e* provided on the receiving port 37*a* contacts the helical rib 52*b* of the sealing shutter 52 and rotates the sealing shutter 52 along the peripheral surface of the feeding pipe 51.

In the first state in which the collected toner box 30 is mounted in the image forming apparatus 10, the rotation of the sealing shutter 52 is stopped in an overlapping state of the delivery port 51*a* with the sealing shutter opening 52*a*. The collected toner in the feeding pipe 51 is discharged into the collected toner box 30 through a hole where the delivery port 51*a* and the sealing shutter opening 52*a* overlap with each other.

(Blind Shutter)

As shown in (b) of FIG. 4, in the first state, when the collected toner is discharged from the delivery port 50*a* into the collected toner box 30, a spent toner passing through the receiving port 51*a* deposits on the sealing shutter opening 52*a*.

As shown in (a) of FIG. 4, in the second state, when the sealing shutter opening 52*a* seals the receiving port 51*a*, a blind shutter 54 covers the sealing shutter opening 52*a*, thus preventing scattering of the toner depositing on the sealing shutter opening 52*a*.

As shown in (b) of FIG. 4, the blind shutter 54 is movable relative to the image forming portion Pa in an arrow B direction perpendicular to an axis of the delivery pipe 51.

(Reaction Force During Mounting and Dismounting)

As shown in (b) of FIG. 4, during the pushing-in of the collected toner box 30, the helical rib 52*b* contacts the contact rib 37*e* of the collected toner box 30 and rotates the sealing shutter 52. In the first state in which the collected toner box 30 is completely mounted in the image forming apparatus 10, a flat plate rib 52*c* contacts the contact rib 37*e* of the collected toner box 30. In the first surface, the contact rib 37*e* passes through the helical rib 52*b* and then reaches the flat plate rib 52*c*, and therefore a force for pushing the collected toner box 30 back in a direction opposite to the insertion direction by the sealing shutter 52 becomes small.

Here, an inclination angle of the helical rib 52*b* with respect to a generatrix direction of the feeding pipe 51 is θ1. An inclination angle of the flat plate rib 52*c*, connected to the helical rib 52*b* in a base position side, with respect to the generatrix direction of the feeding pipe 51 is θ2. In order to make an urging force in a rotational direction by the helical torsion coil spring 53 lower than that during the pushing-in in the first state, the inclination angle θ1 of the helical rib 52*b* and the inclination angle θ2 of the flat plate rib 52*c* are set as follows:

$$\theta 1 > \theta 2.$$

As shown in FIG. 5, reaction force in the pushing in direction by the helical torsion coil spring 53 in a process in which the collected toner box 30 is pushed into the image forming apparatus 10 is f1. Further, reaction force in the pushing-in direction by the helical torsion coil spring 53 in a state in which the mounting of the collected toner box 30 in the image forming apparatus 10 is finished is f2.

When the urging force of the helical torsion coil spring 53 is fc, the reaction force f1 is obtained from the following formula, and is adjustable by the inclination angle θ1 of the helical rib 52*b*.

$$f1 = fc \times \sin\theta 1 \times \cos\theta 1$$

The reaction force f2 is obtained from the following formula, and is adjustable by the inclination angle θ2 of the flat plane rib 52*c*.

$$f2 = fc \times \sin\theta 2 \times \cos\theta 2$$

The sealing shutter 52 and the blind shutter 54 do not generate the reaction force in a separation direction in the first state by setting of the inclination angles as described above. For that reason, even with respect to a blank collected toner box 30, it is possible to maintain a connected state with a collected toner discharging portion 18*a* and the feeding pipe 51 without being constrained to be fixed to a casing of the image forming apparatus 10 by a lever or the like. Then, in a separating process, large reaction force is generated, so that the shutters assist the dismounting of the collected toner box 30.

(Overturning of Collected Toner Box)

As shown in FIG. 3, the image forming apparatus 10 employs a constitution in which the collected toner box 30 is disposed at a lower front surface portion and the collected toner is caused to flow through the plurality of delivery portions 50. From a constraint to a floor area of the image forming apparatus 10, a shape of the collected toner box 30 is thin with respect to a rearward direction.

The collected toner box 30 with respect to the rearward direction has a high center of gravity, and therefore in the case where the collected toner box 30 is tilted in a front-rear direction, the collected toner box 30 is liable to overturn. The overturning of the collected toner box 30 causes the toner scattering, and is undesirable when placing it on the floor or a desk during exchange of the collected toner box 30 is taken into account.

Therefore, it was studied that the collected toner box 30 is provided with a stationary overturning-preventing member and thus is made less likely to overturn. However, the stationary overturning-preventing member is required to form a recess for receiving the overturning-preventing member in the image forming apparatus 10 side. Further, there is a need to ensure a space for receiving the overturning-preventing member between a front panel of the image forming apparatus 10 and the collected toner box 30.

In the following embodiments, the collected toner box 30 is provided with the overturning-preventing member of a development type and thus solves this problem. In the mounted state of the collected toner box 30 in the image forming apparatus 10, the overturning-preventing member is accommodated in a vertically projected plane of the collected toner box 30, and in the state in which the collected toner box 30 is dismounted from the image forming apparatus 10, the collected toner box 30 is developed toward the outside of the vertically projected plane, so that a supporting length with respect to the rearward direction is increased.

<Embodiment 1>

(Overturning Preventing Member)

Figure 7:
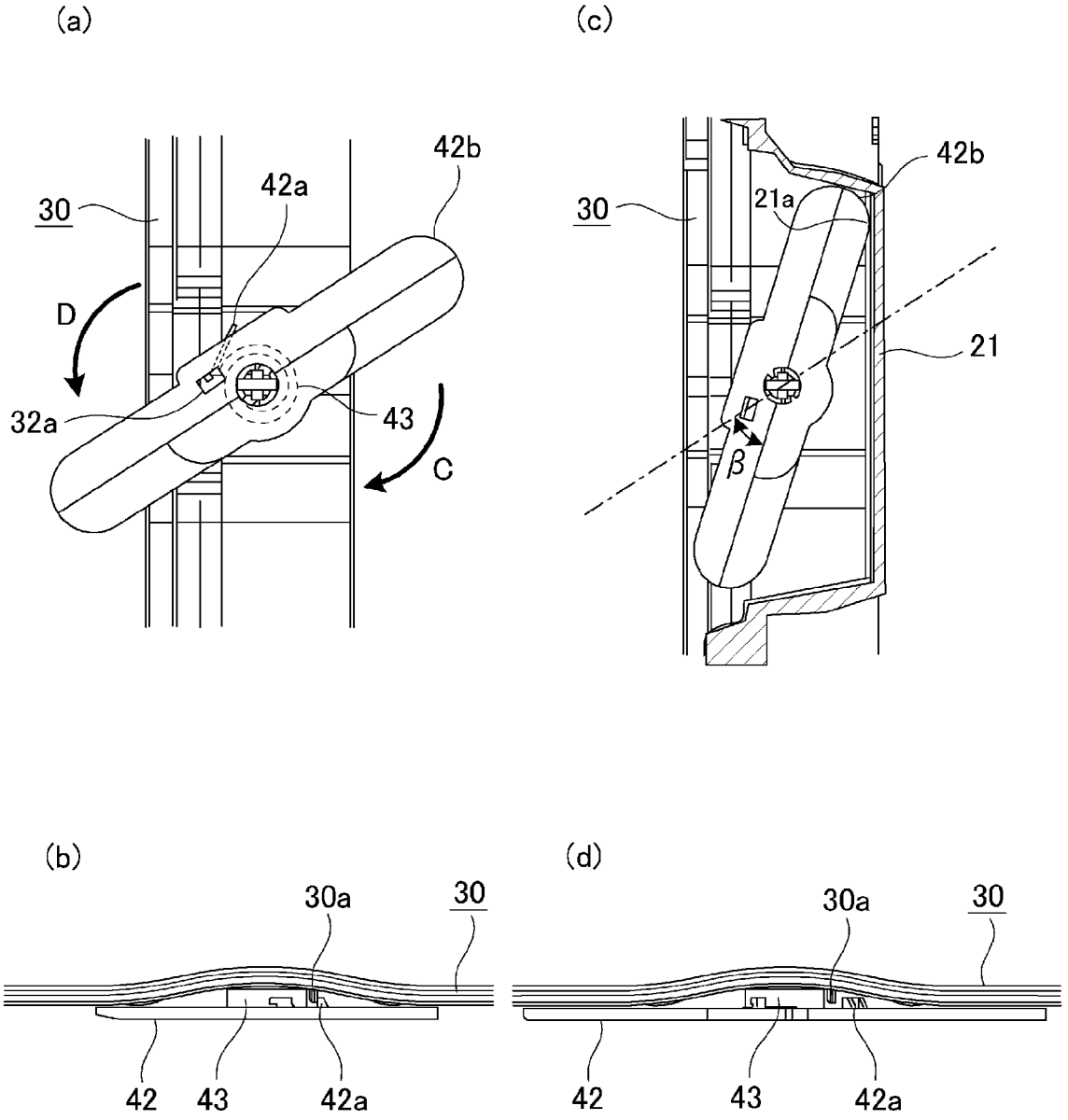
In FIG. 7, (a) to (d) are illustrations of an overturning-preventing member in Embodiment 1.

In FIG. 7, (a) to (d) are illustrations of the overturning-preventing member. In FIG. 7, (a) shows a developed state of the overturning-preventing member as seen from a bottom (surface) side, (b) shows the developer state of the overturning-preventing member as seen from a side-surface side, (c) shows an accommodated state of the overturning-preventing member as seen from the bottom side, and (d) shows the accommodated state of the overturning-preventing member as seen from the side-surface side.

As shown in (b) of FIG. 1, the collected toner box 30 which is an example of a collecting container is provided detachably mountable to the main assembly of the image forming apparatus 10, and collects the toner fed from the main assembly. The sealing shutters 52 and the shutter 38 which are examples of the shutter open and close the connecting portions between the main assembly and the collected toner box 30. The delivery portion 50*a* causes the collected toner in the image forming portion to flow into the collected toner box 30 via the rotary-type shutter. The belt cleaning device connecting portion 18*s* causes the collected toner in the belt cleaning device 18 to flow into the collected toner box 30 via the slide-type shutter.

As shown in FIG. 2, the accommodating portion 32 which is an example of a container portion is connected to the main assembly by the plurality of delivery portions 50*a* and the belt cleaning device connecting portion 18*s* larger in total reaction force in a dismounting direction than the delivery portions 50*a* when the accommodating portion 32 is connected to the main assembly. The accommodating portion 32 is provided with a collected toner box lower surface 32*a* which is an example of the accommodating portion.

As shown in FIG. 4, the helical torsion coil spring 53 and the shutter spring 38*b* which are examples of a first urging member urge these shutters in a closing direction. As shown in FIG. 7, a helical torsion coil spring 43 which is an example of a second urging member urges the overturning-preventing member 42 in a direction of rotating and projecting the overturning-preventing member 42. The delivery portions 50*a* which are examples of a first connecting portion are arranged and disposed in the horizontal direction, and are provided with the sealing shutters 52 (first shutter), respectively. The belt cleaning device connecting portion 18*s* which is an example of a second connecting portion is provided locally in one side of the collected toner box 30 with respect to the horizontal direction. The belt cleaning device connecting portion 18*s* is provided with the shutter 38 (second shutter) larger in reaction force against the collected toner box 30 in the connected state than the sealing shutters 52.

As shown in FIG. 7, the overturning-preventing member 42 is provided rotatably relative to the collected toner box 30 and projects outwardly from a side portion of the collected toner box 30 in the main assembly side with the mounting and dismounting operation of the collected toner box 30, thus preventing the overturning of the collected toner box 30. The overturning-preventing member 42 contacts the main assembly in a process in which the collected toner box 30 is connected to the main assembly of the image forming apparatus 10 and is accommodated in the lower surface 32*a* of the collected toner box 30, and when the collected toner box 30 is separated from the main assembly, the overturning-preventing member 42 projects outwardly from the side portion of the collected toner box 30 in the main assembly side, thus preventing the overturning of the accommodating portion 32. As shown in FIG. 2, the overturning-preventing member 42 is provided locally in one side of the collected toner box 30 in the horizontal direction, and is disposed in a side opposite from a side, with respect to the horizontal direction, where the belt cleaning device connecting portion 18*s* of the accommodating portion 32 is disposed. During the mounting of the collected toner box 30 in the main assembly, the sum of rotation moment acting on the collected toner box 30 by the helical torsion coil spring 53 and the sealing shutter 38a and rotation moment acting on the collected toner box 30 by the helical torsion coil spring 43 are directed in directions opposite to each other.

As shown in (b) of FIG. 3, the casing of the image forming apparatus 10 is provided with a guiding portion 10*a* for guiding the collected toner box 30 in the horizontal direction to permit dismounting of the collected toner box 30 from a predetermined position. As shown in (c) of FIG. 7, the casing of the image forming apparatus 10 is provided with a contact portion 21*a* which contacts and rotates the overturning-preventing member 42.

As shown in (c) of FIG. 2, when the collected toner box 30 is dismounted from the image forming apparatus 10 and is placed in the second state, the overturning-preventing member 42 rotates in an arrow C direction from a state in which the overturning-preventing member 42 is hidden in the projected plane of the collected toner box 30, and projects from the projected plane of the collected toner box 30. The overturning-preventing member 42 is held in a state in which the overturning-preventing member 42 projects from the bottom of the collected toner box 30, whereby a depth of the collected toner box 30 in the second state is increased, and thus the collected toner box 30 is not readily overturned.

As shown in (a) of FIG. 7, the overturning-preventing member 42 is urged in the arrow C direction by the helical torsion coil spring 43. The overturning-preventing member 42 is rotated until the rib 30*a* provided at the bottom of the collected toner box 30 and a rib 42*a* provided on the overturning-preventing member 42 contact each other. The ribs 30*a* and 42*a* contact each other, so that rotation of the overturning-preventing member 42 is stopped in a state in which the overturning-preventing member 42 projects from the bottom of the collected toner box 30.

As shown in (b) of FIG. 7, in a process in which the collected toner box 30 is pushed into the image forming apparatus 10, a free end portion 42*b* of the overturning-preventing member 42 contacts a contact portion 21*a* of an interior cover 21 of the image forming apparatus 10, so that the overturning-preventing member 42 is rotated in an arrow D direction. When the collected toner box 30 is completely mounted in the image forming apparatus 10 and thus is placed in the first state, the overturning-preventing member 42 is accommodated in the projected surface of the collected toner box 30.

An angle β formed between the overturning-preventing member 42 in the second state and the overturning-preventing member 42 in the first state is 90° or less. For this reason, the overturning-preventing member 42 is smoothly rotated in the process in which the collected toner box 30 is pushed into the image forming apparatus 10. Further, in a process in which the collected toner box 30 is rotated from the second state to the first state, the overturning-preventing member 42 and the collected toner box 30 are not placed in a perpendicular state. For this reason, in the process in which the collected toner box 30 is pushed into the image forming apparatus 10, there is no phenomenon such that the overturning-preventing member 42 thrusts and prevents the pushing-in of the collected toner box 30. These conditions are satisfied, in Embodiment 1, as a load for rotating the overturning-preventing member 42 is kept at a low level, so that a pushing-in operation of the collected toner box 30 can be completed at a relatively small force.

(Rotation Moment Acting on Collected Toner Box)

Figure 8:
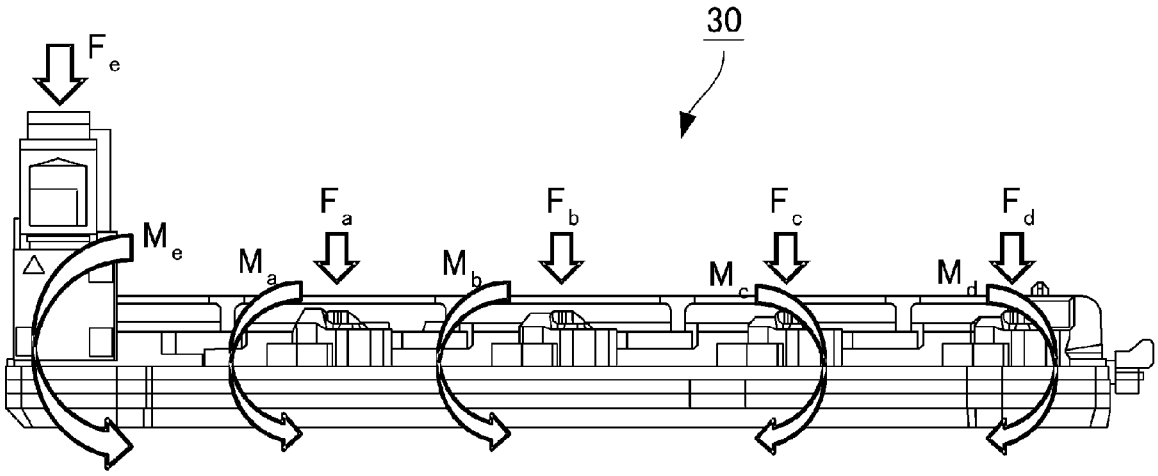
In FIG. 8, (a) and (b) are illustrations of a rotation moment suppressing effect by the overturning-preventing member.
Figure 8:
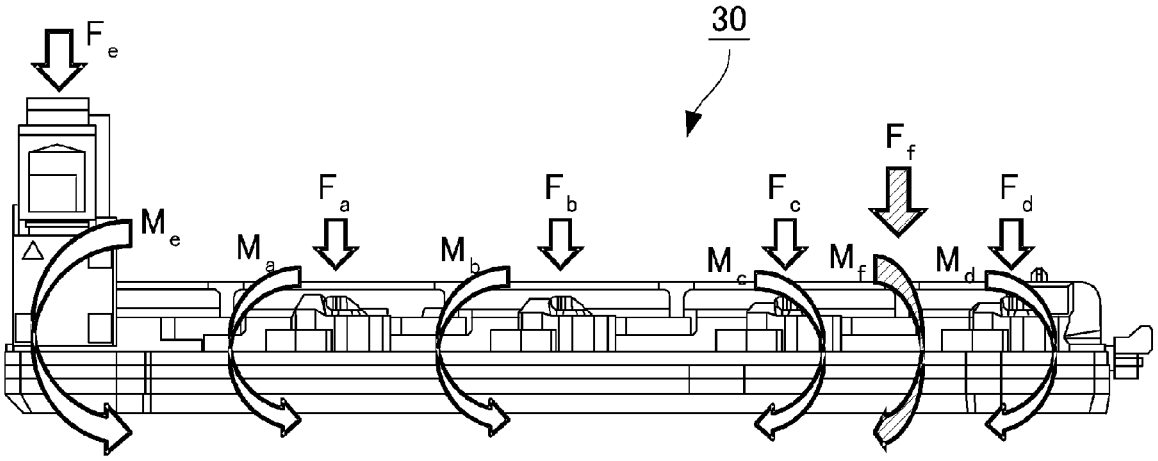

In FIG. 8, (a) and (b) are illustrations of a rotation moment suppressing effect by the overturning-preventing member. In FIG. 8, (a) shows Comparison Example, and (b) shows Embodiment 1.

As shown in (b) of FIG. 1 with reference to FIG. 3, in Comparison Example, the collected toner box 30 is mounted at a predetermined position of the image forming apparatus 10 in a detachable mountable manner. The delivery portions 50*a*, 50*b*, 50*c*and 50*d* of the image forming apparatus 10 are provided with the above-described shutters 52. At the connecting portion between the intermediary transfer belt cleaning device 18 and the collected toner box 30, the slide-type shutter 38 described above is provided.

As shown in (a) of FIG. 8, the four shutters 52 provided on the delivery portions 50*a*, 50*b*, 50*c* and 50*d* exert reaction forces Fa, Fb, Fc and Fd on the collected toner box 30 in the process in which the collected toner box 30 is pushed into the image forming apparatus 10. Further, the shutter 38 provided at the connecting portion between the belt cleaning device 18 and the collected toner box 30 exerts a reaction force Fe on the collected toner box 30.

In general, a collected toner amount of the intermediary transfer belt cleaning device 18 in which collected toners for a plurality of colors are merged and discharged is larger than a collected toner amount of the drum cleaning devices 15*a*, 15*b*, 15*c* and 15*d* for plurality of colors. The reaction force Fe of the slide-type shutter 38 formed in a large size reflecting the collected toner amount is larger than the reaction forces Fa, Fb, Fc and Fd of the sealing shutters 52.

$$Fa=Fb=Fc=Fd\leq Fe$$

In Comparison Example, by the springs 53 and 38*a* provided on the sealing shutters 52 and the shutter 38, the reaction forces Fa, Fb, Fc, Fd and Fe in a dismounting direction of the collected toner box 30 from the image forming apparatus 10 act on the collected toner box 30 during the pushing-in of the collected toner box 30. During the mounting of the collected toner box 30, there is a need to position the receiving ports 37*a*, 37*b*, 37*c* and 37*d*relative to the delivery portions 50*a*, 50*b*, 50*c* and 50*d* while avoiding the dismounting of the collected toner box 30 by the reaction forces Fa, Fb, Fc, Fd and Fe. During the pushing-in of the collected toner box 30, there is a need to vertically insert the collected toner box 30 into the delivery portions 50*a*, 50*b*, 50*c* and 50*d* while maintaining an attitude of the collected toner box 30 against the reaction forces Fa, Fb, Fc, Fd and Fe.

Further, the reaction forces Fa, Fb, Fc, Fd and Fe generate rotation moment Ma, Mb, Mc, Md and Me with respect to the collected toner box 30. As described above, $Fa=Fb=Fc=Fd\leq Fe$ holds, and therefore with respect to the collected toner box 30, the rotation moment in the counterclockwise direction is generated as a whole as seen from above the collected toner box 30. When the rotation moment is generated with respect to the collected toner box 30 during the pushing-in, a balance between forces required for the pushing-in of the collected toner box 30 in the left and right directions is destroyed, and therefore operativity is lowered compared with the case where the rotation moment is not generated. A probability that the collected toner box 30 is obliquely pushed in at left and right portions to cause generation of operation errors also becomes high.

Therefore, commonality of the four sealing shutters 52 and the shutter 38 was studied. However, the shutter 38 was excessively large for replacing the sealing shutters 52 therewith. Further, if the sealing shutters 52 are changed to the shutter 38, it was anticipated that the reaction forces Fa, Fb, Fc, Fd and Fe are increased and thus the operativity when the collected toner box 30 is pushed into the image forming apparatus 10 is further lowered.

Further, based on a premise that the above-described relationship of: $Fa=Fb=Fc=Fd\leq Fe$ holds, it was studied that the arrangement of the delivery portions 50*a*, 50*b*, 50*c* and 50*d* is changed so as not to generate the rotation moment as a whole. However, the change in arrangement of the delivery portions 50*a*, 50*b*, 50*c* and 50*d* increases constraints to design of the image forming apparatus 10 and the collected toner box 30, and adversely affects downsizing of the image forming apparatus 10 and volume of the collected toner box 30.

On the other hand, as shown in (b) of FIG. 8, in Embodiment 1, by adjusting the arrangement of the overturning-preventing member 42, the rotation moment is prevented as a whole from generating with respect to the collected toner box 30. By providing the overturning-preventing member 42, the operativity when the collected toner box 30 is mounted in the image forming apparatus 10 is improved.

A reaction force generated by bringing the overturning-preventing member 42 into contact with the disposition surface of the collected toner box 30 of the image forming apparatus is Ff. An effect of stabilizing the center of gravity of the collected toner box 30 by the overturning-preventing member 42 can be obtained even when the overturning-preventing member 42 is disposed at any position with respect to the left-right direction of the collected toner box 30. For this reason, the reaction forces Fa, Fb, Fc, Fd and Fe acting on the receiving ports 37*a*, 37*b*, 37*c* and 37*d* at the upper portion of the collected toner box 30 are canceled by the reaction force Ff resulting from a frictional force between the overturning-preventing member 42 disposed at the lower portion of the collected toner box 30 and the disposition surface of the collected toner box 30.

The rotation moment with which the frictional force between the overturning-preventing member 42 and the disposition surface of the collected toner box 30 acts on the collected toner box 30 is Mf. The rotation moment Mf acting on the collected toner box 30 by the overturning-preventing member 42 varies depending on the disposition of the overturning-preventing member 42 such that the overturning-preventing member 42 is disposed at which position with respect to the left-right direction of the collected toner box 30.

As shown in (c) of FIG. 2, in Embodiment 1, by disposing the overturning-preventing member 42 at a right-side position of the collected toner box 30, the rotation moment Me exerted on the collected toner box 30 by the left-side shutter 38 of the collected toner box 30 is roughly canceled. The overturning-preventing member 42 is disposed in the right side of a left-right center line of the collected toner box 30 correspondingly to the disposition such that a connecting port with the cleaning device 18 where the maximum rotation moment Me is generated is disposed in the left side of the collected toner box 30.

As a result, the rotation moment Mf generated by the overturning-preventing member 42 cancels counterclockwise rotation moment exerted on the collected toner box 30 by the four sealing shutters 52 and the shutter 38 as a whole. The rotation moment acting on the collected toner box 30 is canceled, whereby an operativity improving effect during the mounting of the collected toner box 30 is obtained. In addition to the overturning-preventing effect which is a natural purpose, an operativity-improving effect during the mounting and dismounting is obtained.

(Effect of Embodiment 1)

As shown in (c) of FIG. 2, the connecting position of the shutter 38 with the collected toner box 30 is disposed by shifting the shutter 38 in one of widthwise directions perpendicular to a separating direction and a height direction of the collected toner box 30. The overturning-preventing member 42 is disposed by being shifted in another widthwise direction of the collected toner box 30.

For this reason, left and right tensile forces with respect to the widthwise directions when the collected toner box 30 is pulled out become substantially the same, so that the collected toner box 30 is easily pulled out in a straight line. The generation of unnecessary load and friction on the feeding pipe 51 and the like due to obliquely pulling-out of the collected toner box 30 is prevented.

As shown in (c) of FIG. 7, the overturning-preventing member 42 is disposed rotatably along a disposition table at the lower surface of the collected toner box 30. The helical torsion coil spring 43 causes a torque to act in a direction of rotating the shutter 38, with respect to the widthwise direction of the collected toner box 30, toward the collected toner discharging portion 18*a* of the belt cleaning device 18 shown in (b) of FIG. 1.

For this reason, the reaction force of the shutter 38 is canceled by the torque, so that even the blank collected toner box 30 can maintain the connection while withstanding the reaction force.

In Embodiment 1, the overturning-preventing member 42 developed and accommodated in interrelation with the mounting and dismounting of the collected toner box 30 relative to the image forming apparatus 10 is provided on the collected toner box 30, and therefore it was possible to render the collected toner box 30 less likely to overturn without making the change with respect to the image forming apparatus 10.

In Embodiment 1, the overturning-preventing member 42 is disposed so as to cancel "the rotation moment generated with respect to the collected toner box by the urging force for closing the plurality of shutters", and therefore compared with Comparison Example, the operativity of the mounting and dismounting of the collected toner box 30 was able to be improved.

In Embodiment 1, the overturning-preventing member 42 is provided horizontally rotatable relative to the bottom of the collected toner box 30, and therefore at any position during the development, the overturning-preventing effect can be achieved by increasing the length with respect to the depth direction.

In Embodiment 1, the overturning-preventing member 42 is opened and closed by abutting against a wall surface in the image forming apparatus 10 in interrelation with an operation for moving the overturning-preventing member 42 along the disposition surface of the collected toner box 30, and therefore at any position during the development, it is possible to ensure the length with respect to the depth direction to the maximum.

In Embodiment 1, the overturning-preventing member 42 is disposed at a position where the rotation moment with which the plurality of shutters act on the collected toner box 30 is canceled, and therefore the mounting and dismounting property of the collected toner box 30 was improved.

Incidentally, in the case where the shutter urged by the spring is provided also at the receiving port of the collected toner box 30, in consideration of also the rotation moment by the spring urging force of the shutter at the receiving port, it is desirable that the overturning-preventing member 42 is disposed so as to cancel the rotation moment as a whole. As a result, the mounting and dismounting property of the collected toner box 30 can be further improved.

<Embodiment 2>

Figure 9:
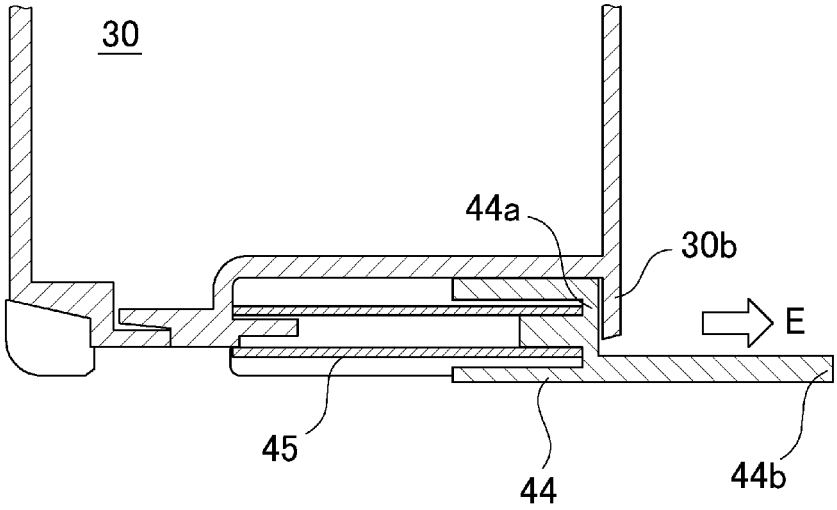
In FIG. 9, (a) and (b) are illustrations of an overturning-preventing member in Embodiment 2.
Figure 9:
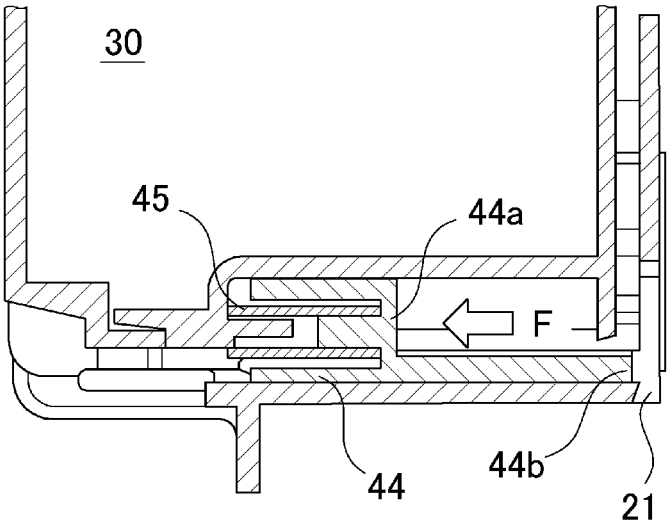

In FIG. 9, (a) and (b) are illustrations of an overturning-preventing member in Embodiment 2. In FIG. 9, (a) shows a state in which the overturning-preventing member is developed from a collected toner box, and (b) shows a state in which the overturning-preventing member is accommodated in the collected toner box.

In Embodiment 1, the overturning-preventing member rotationally moves in the flat plane of the bottom of the collected toner box. On the other hand, in Embodiment 2, the overturning-preventing member reciprocates on the bottom of the collected toner box in the horizontal direction. Other constitutions are common to Embodiments 1 and 2, and therefore in FIG. 9, the constitutions common to Embodiments 1 and 2 are represented by reference numerals or symbols common to FIGS. 1 to 7 and will be omitted from redundant description.

As shown in (a) of FIG. 9, in Embodiment 2, at the bottom of the collected toner box 30, an overturning-preventing member 44 operating in parallel to the insertion and extraction direction of the collected toner box 10 relative to the image forming apparatus 10 is provided. The overturning-preventing member 44 is always urged in an arrow E direction parallel to the insertion and extraction direction by a compression spring 45.

When the collected toner box 30 is in the second state in which the collected toner box 30 is dismounted from the image forming apparatus 10, the overturning-preventing member 44 moves in the arrow E direction from a state in which the overturning-preventing member 44 is hidden in the projected plane of the collected toner box 30, and projects from the projected plane of the collected toner box 30. The overturning-preventing member 44 moves until an abutting surface 44*a* provided on the overturning-preventing member 44 contacts a stopper 30*b* provided on a side surface of the collected toner box 30 and then stops.

The overturning-preventing member 44 is held in a state in which the overturning-preventing member 44 projects from the bottom of the collected toner box 30, whereby a depth of the collected toner box 30 in the second state is increased, and thus an overturning-preventing effect in a self-supporting state is achieved.

As shown in (b) of FIG. 9, when the collected toner box 30 is mounted into the image forming apparatus 10, a free end portion 44*b* of the overturning-preventing member 44 contacts an interior cover 21 of the image forming apparatus 10, so that the overturning-preventing member 44 is pushed in an arrow F direction against the compression spring 45. Thereafter, when the collected toner box 30 is mounted in the image forming apparatus 10 and thus is placed in the first state, the overturning-preventing member 44 falls within the projected surface of the collected toner box 30. The overturning-preventing member 44 provided on the collected toner box 30 is provided so as to capable of being translated from the rear surface of the collected toner box 30 in the insertion and extraction direction, and abuts against the wall surface in the image forming apparatus 10, and is developed and accommodated in interrelation with the inserting and extracting operation.

Similarly as in the rotary-type overturning-preventing member 42 in Embodiment 1, an effect of stabilizing the center of gravity of the collected toner box 30 by the overturning-preventing member 44 can be obtained even when the overturning-preventing member 42 is disposed at any position with respect to the left-right direction of the collected toner box 30. On the other hand, the rotation moment Mf acting on the collected toner box 30 by the overturning-preventing member 44 varies depending on the disposition of the overturning-preventing member 44 such that the overturning-preventing member 44 is disposed at which position with respect to the left-right direction of the collected toner box 30 is most effective.

Therefore, a mounting position of the overturning-preventing member 44 is adjusted so as to cancel rotation moment exerted on the collected toner box 30 by the four sealing shutters 52 and the shutter 38 as a whole. In addition to the overturning-preventing effect, an operativity-improving effect during the insertion and extraction is obtained by disposing a direct-acting overturning-preventing member 44 at the right-side position of the collected toner box 30.

<Embodiment 3>

Figure 10:
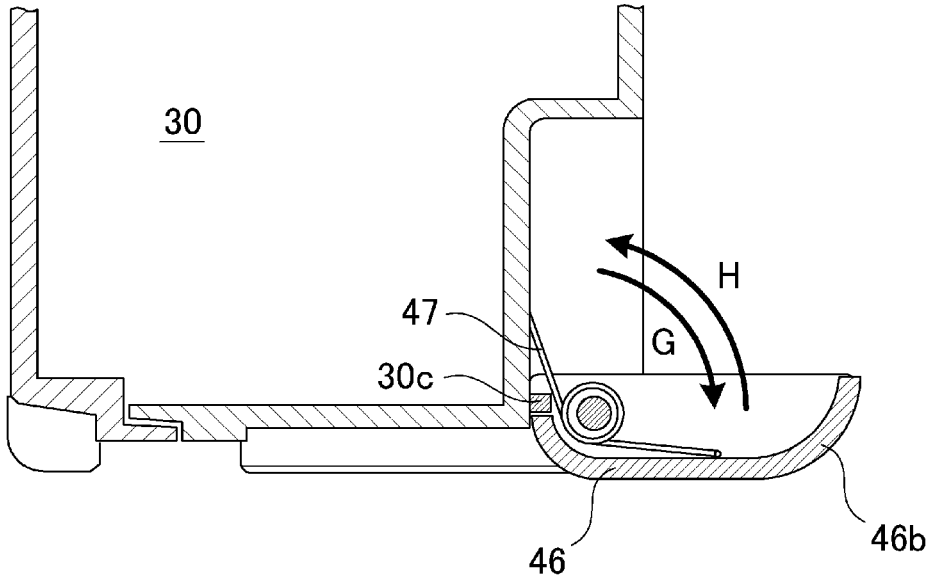
In FIG. 10, (a) and (b) are illustrations of an overturning-preventing member in Embodiment 3.
Figure 10:
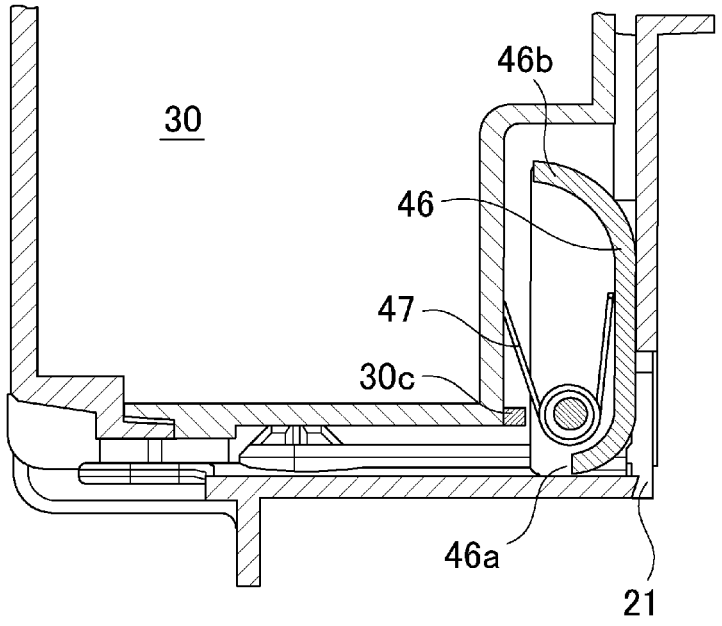

In FIG. 10, (a) and (b) are illustrations of an overturning-preventing member in Embodiment 2. In FIG. 10, (a) shows a state in which the overturning-preventing member is projected from a collected toner box, and (b) shows a state in which the overturning-preventing member is accommodated in the collected toner box.

In Embodiment 1, the overturning-preventing member rotationally moves in the flat plane of the bottom of the collected toner box. On the other hand, in Embodiment 3, the overturning-preventing member rotates vertically relative to the bottom of the collected toner box in the horizontal direction. Other constitutions are common to Embodiments 1 and 3, and therefore in FIG. 10, the constitutions common to Embodiments 1 and 3 are represented by reference numerals or symbols common to FIGS. 1 to 7 and will be omitted from redundant description.

As shown in (a) of FIG. 10, the overturning-preventing member 44 is always urged in an arrow G direction parallel to the insertion and extraction direction by a helical torsion coil spring 47. When the collected toner box 30 is in the second state in which the collected toner box 30 is dismounted from the image forming apparatus 10, the overturning-preventing member 46 moves in the arrow G direction from a state in which the overturning-preventing member 46 is hidden in the projected plane of the collected toner box 30, and is in a state in which the overturning-preventing member 46 projects from the projected plane of the collected toner box 30. The overturning-preventing member 46 rotates until an abutting surface 46*a* provided on the overturning-preventing member 46 contacts a stopper 30*c* provided on a rear surface of the collected toner box 30 and then stops. The overturning-preventing member 46 is held in a state in which the overturning-preventing member 46 projects from the bottom of the collected toner box 30, whereby a depth of the collected toner box 30 is increased, and thus an overturning-preventing effect in a self-supporting attitude in the second state is achieved.

As shown in (b) of FIG. 10, when the collected toner box 30 is inserted into the image forming apparatus 10, a free end portion 46*b* of the overturning-preventing member 46 contacts an interior cover 21 of the image forming apparatus 10, so that the overturning-preventing member 46 is rotated in an arrow H direction. Thereafter, when the collected toner box 30 is in the first state in which the collected toner box 30 is mounted in the image forming apparatus 10, the overturning-preventing member 46 falls within the projected surface of the collected toner box 30. The overturning-preventing member 46 is provided rotatably relative to the rear surface of the collected toner box 30 in the insertion and extraction direction, and abuts against the wall surface in the image forming apparatus 10, and is developed and accommodated in interrelation with the inserting and extracting operation of the collected toner box 30.

Similarly as in the rotary-type overturning-preventing member 42 in Embodiment 1, an effect of stabilizing the center of gravity of the collected toner box 30 by the overturning-preventing member 46 can be obtained even when the overturning-preventing member 42 is disposed at any position with respect to the left-right direction of the collected toner box 30. On the other hand, the rotation moment Mf acting on the collected toner box 30 by the overturning-preventing member 46 varies depending on the disposition of the overturning-preventing member 46 such that the overturning-preventing member 46 is disposed at which position with respect to the left-right direction of the collected toner box 30 is most effective.

Therefore, a mounting position of the overturning-preventing member 44 is adjusted so as to cancel rotation moment exerted on the collected toner box 30 by the four sealing shutters 52 and the shutter 38 as a whole. In addition to the overturning-preventing effect, an operativity-improving effect during the insertion and extraction is obtained by disposing the rotary-type overturning-preventing member 46 at the right-side position of the collected toner box 30.

<Other Embodiments>

The present invention can be carried out also in other embodiments in which a part or all of constitutions in the above-described embodiments are replaced with alternative constitutions so long as the overturning-preventing member capable of being developed from and accommodated in the collected toner box is provided.

In this embodiment, the tandem-type color image forming apparatus is described, but the present invention is applicable to also other various image forming apparatuses. If the image forming apparatus is the image forming apparatus in which the collected toner generates, the present invention can be carried out irrespective of one-component developer/two-component developer, the number of the image forming portions, the presence or absence of the intermediary transfer member, the presence or absence of the recording material, the presence or absence of the recording material feeding member, the charging type, the electrostatic image forming type, the transfer type and the fixing type.

With respect to dimensions, materials, shapes and relative arrangement of the constituent elements described in Embodiments 1 to 3, the scope of the present invention is not intended to be limited thereto. In the above-described embodiments, only a principal portion relating to toner image formation and transfer is described, but the present invention can be carried out in various uses such as printers, various printing machines, copying machines, facsimile machines, and multi-function machines, by adding necessary equipment, devices and casing structures.

In the image forming apparatus of the present invention, in the connecting state of the collecting container, the rotation moment direction in the opposite direction to the sum of the rotation moment exerted on the collecting container by the plurality of shutters is caused to act on the collecting container by the overturning-preventing member. Accordingly, it is possible to alleviate the unnecessary rotation moment acting on the collecting container.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 195150/2013 filed Sep. 20, 2013, which is hereby incorporated by reference.

What is claimed is:

1. An image forming apparatus comprising:

a collecting container, provided detachably mountable to a main assembly of said image forming apparatus, for collecting toner fed from the main assembly;

a plurality of connecting portions, provided at one side surface of said collecting container, for connecting the main assembly and said collecting container;

a plurality of shutters for opening and closing said plurality of connecting portions, respectively;

a plurality of first urging members for urging said plurality of shutters, respectively, in a closing direction;

a movable member provided movably at a bottom of said collecting container, wherein said movable member is moved toward said collecting container by contact with the main assembly when said collecting container is mounted in a mounting portion of the main assembly, and is projected outwardly from a side portion of said collecting container when said collecting container is dismounted from the mounting portion; and a second urging member for urging said movable member in a direction projecting from said collecting container, wherein when said collecting container is mounted in the main assembly, said plurality of first urging members and said second urging member are provided so that a sum of rotation moment acting on said collecting container by said plurality of first urging members and rotation moment acting on said collecting container by said second urging member are directed opposite to each other.

2. An image forming apparatus according to claim 1, further comprising:

a plurality of image bearing members for bearing toner images; and an intermediary transfer member onto which the toner images formed on said plurality of image bearing members are to be transferred, wherein said plurality of connecting portions include a plurality of first connecting portions for delivering the toner collected from said plurality of image bearing members and a second connecting portion for delivering the toner collected from said intermediary transfer member, and the plurality of first urging members includes first connection portions urging members for urging the shutters for opening and closing said plurality of first connecting portions, and a second connecting portion urging member for urging the shutter for opening and closing said second connecting portion, and wherein a reaction force exerted on said collecting container by each of said first connecting portion urging members is smaller than a reaction force exerted on said collecting container by said second connecting portion urging member.

3. An image forming apparatus according to claim 1, wherein said movable member is provided to be rotatable relative to said collecting container.

4. A collecting container provided detachably mountable to a main assembly of an image forming apparatus, comprising:

an accommodating portion for accommodating toner;

a plurality of inflowing portions, provided at one side surface of said collecting container, for permitting inflow of the toner;

a plurality of shutters for opening and closing said plurality of inflowing portions, respectively;

a plurality of first urging members for urging said plurality of shutters, respectively, in a closing direction;

a movable member provided movably at a bottom of said accommodating portion, wherein said movable member is moved toward a side portion of said collecting container by contact with the main assembly when said collecting container is mounted in a mounting portion of the main assembly, and is projected outwardly from the side portion of said collecting container when said collecting container is dismounted from the mounting portion; and a second urging member for urging said movable member in a direction projecting from the side portion of said collecting container, wherein when said collecting container is mounted in the main assembly, said plurality of first urging members and said second urging member are provided so that a sum of rotation moment acting on said collecting container by said plurality of first urging members and rotation moment acting on said collecting container by said second urging member are directed opposite to each other.

5. A collecting container according to claim 4, wherein said plurality of inflowing portions include a plurality of first inflowing portions each for delivering the toner collected from an associated one of a plurality of image bearing members for bearing toner images and a second inflowing portion for delivering the toner collected from an intermediary transfer member onto which the toner images formed on the plurality of image bearing members are to be transferred, and the plurality of first urging members include first inflowing portion urging members for urging the shutters for opening and closing said plurality of first inflowing portions and a second inflowing portion urging member for urging the shutter for opening and closing said second inflowing portion, and wherein a reaction force exerted on said collecting container by each of said first inflowing portion urging members is smaller than a reaction force exerted on said collecting container by said second inflowing portion urging member.

6. A collecting container according to claim 4, wherein said movable member is provided to be rotatable relative to said collecting container.

* * * * *